US006804474B2

(12) United States Patent
Morita et al.

(10) Patent No.: US 6,804,474 B2
(45) Date of Patent: Oct. 12, 2004

(54) IMAGE FORMING APPARATUS

(75) Inventors: Tetsuya Morita, Kanagawa (JP); Kunio Tsuruno, Tokyo (JP); Keizo Isemura, Tokyo (JP); Ikuo Takeuchi, Ibaraki (JP); Ichiro Sasaki, Ibaraki (JP); Masahiro Kurahashi, Tokyo (JP); Atsushi Nakagawa, Ibaraki (JP); Kenji Fukushi, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/199,299

(22) Filed: Jul. 22, 2002

(65) Prior Publication Data

US 2003/0021608 A1 Jan. 30, 2003

(30) Foreign Application Priority Data

| | | |
|---|---|---|
| Jul. 24, 2001 | (JP) | 2001-223070 |
| Jul. 24, 2001 | (JP) | 2001-223071 |
| Jul. 24, 2001 | (JP) | 2001-223072 |
| Jun. 18, 2002 | (JP) | 2002-177154 |

(51) Int. Cl.[7] ..... G03G 15/00

(52) U.S. Cl. ..... 399/23; 399/21; 399/22; 399/393; 271/153

(58) Field of Search ..... 271/152, 153, 271/154, 155, 259; 399/18, 21, 22, 23, 43, 361, 363, 381, 389, 391, 393

(56) References Cited

U.S. PATENT DOCUMENTS

| | | | | |
|---|---|---|---|---|
| 5,486,903 | A | | 1/1996 | Kanno et al. |
| 5,689,759 | A | | 11/1997 | Isemura et al. ..... 399/45 |
| 5,815,280 | A | | 9/1998 | Ohmura et al. ..... 358/296 |
| 5,815,786 | A | | 9/1998 | Isemura ..... 399/376 |
| 5,839,015 | A | * | 11/1998 | Faguy et al. ..... 399/23 |
| 5,940,543 | A | | 8/1999 | Isemura et al. ..... 382/284 |
| 6,137,968 | A | * | 10/2000 | Sunou et al. ..... 399/23 |
| 6,325,585 | B1 | | 12/2001 | Sasaki et al. ..... 412/11 |
| 6,567,620 | B2 | * | 5/2003 | Brown, Jr. et al. ..... 399/18 |
| 6,585,344 | B2 | * | 7/2003 | Kolodziej ..... 347/19 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus is provided which includes a sheet containing section for containing sheets, a conveying member and a conveying path for conveying the sheets, at least one optical sensor that is arranged in the conveying path and has a light emitting element and a light receiving element for detecting presence or absence of a sheet on the conveying path, a driver for changing an amount of emitted light of the optical sensor, a sheet supply operation detecting section for detecting a supply operation of the sheets contained in the sheet containing section, and a control section for adjusting an amount of emitted light of the optical sensor according to an output of the sheet supply operation detecting section.

29 Claims, 14 Drawing Sheets

FIG. 9

| CASES | STATE OF CASSETTE \ SENSOR | 202 | 203 | 212 | 213 |
|---|---|---|---|---|---|
| 1 | 36: ON SHEET FEEDING<br>37: AT SUPPLY OF SHEETS | — | — | ○ | ○ |
| 2 | 36: AT SUSPENSION OF SHEET FEEDING<br>37: AT SUPPLY OF SHEETS | — | ○ | ○ | ○ |
| 3 | 36: AT SUPPLY OF SHEETS<br>37: ON SHEET FEEDING | ○ | — | — | — |
| 4 | 36: AT SUPPLY OF SHEETS<br>37: AT SUSPENSION OF SHEET FEEDING | ○ | ○ | — | — |

FIG. 14

| CASES | SENSOR | 202 | 203 | 212 | 213 |
|---|---|---|---|---|---|
| 1 | 36: ON FEEDING SHEET<br>37: AT DRAW-OUT OF CASSETTE | — | — | ○ | ○ |
| 2 | 36: AT SUSPENSION OF SHEET FEEDING<br>37: AT DRAW-OUT OF CASSETTE | — | ○ | ○ | ○ |
| 3 | 36: AT DRAW-OUT OF CASSETTE<br>37: ON FEEDING SHEET | ○ | — | — | — |
| 4 | 36: AT DRAW-OUT OF CASSETTE<br>37: AT SUSPENSION OF SHEET FEEDING | ○ | ○ | — | — |

IMAGE FORMING APPARATUS

BACKGROUND OF THE INVENTION

1. Field of the Invention

The present invention relates to an image forming apparatus that has a light emitting element for emitting light and a light receiving element for receiving reflected light of the light emitted from the light emitting element as means for detecting presence or absence of a sheet on a sheet conveying path.

2. Related Background Art

In a conventional image forming apparatus, a photo-interrupter, which is a mechanical detecting method, is used as means for detecting a sheet on a sheet conveying path. The photo-interrupter has a movable plate between a light emitting element and a light receiving element in a photocoupler, and light from the light emitting element side can reach the light receiving element side without being blocked when the photo-interrupter does not detect a recording sheet. Thus, a constant voltage is outputted.

In contrast to this, when the photo-interrupter detects a recording sheet, the recording sheet bumps against the movable plate to move the plate, and light emitted from the light emitting element side is blocked before the light reaches the light receiving element side. Thus, no voltage is outputted. Therefore, the image forming apparatus can judge presence or absence of the recording sheet according to presence or absence of an output voltage in both the cases. Then, immediately after the recording sheet passes the photo-interrupter, the movable plate is apt to return to its original position by a force of a spring or the like. At this point, the movable plate returns to the original position while being vibrated by a reaction of the spring, and an output level of the light receiving element fluctuates around a level where the photo-interrupter can detect presence or absence of the recording sheet. As a result, the image forming apparatus cannot accurately detect whether the recording sheet is present or not.

In order to feed sheets at high speed and with accuracy, it is necessary to keep an interval between the sheets constant. For this purpose, the image forming apparatus has to judge a leading end and a trailing end of a recording sheet accurately. However, if chattering due to mechanical vibration as in the above-described photo-interrupter occurs, the trailing end of the recording sheet cannot be detected accurately.

In order to prevent such a disadvantage and detect presence or absence of a sheet at high speed, a reflective optical sensor has been used in an image forming apparatus. The reflective optical sensor utilizes a phenomenon that an output differs depending on a difference in a reflection intensity between a recording sheet and a plate of a material with high reflectivity. Thus, this sensor does not come into contact with the recording sheet and makes it possible to detect the recording sheet at high speed.

However, the reflective optical sensor has a disadvantage that an output value fluctuates. As to a factor of the fluctuation of the output value, it can be considered that a light emitting element and a light receiving element deteriorate due to wear and reflectivity of a reflection plate deteriorates by sheet powder when a sheet is fed.

In optical sheet detecting means, the more an electric current is flown, the higher luminance a light emitting element has and the larger dynamic range with respect to presence or absence of a medium can be secured. Thus, reliability of detection accuracy is improved. However, since an electric current value is increased, the service life of the light emitting element is reduced. In the case of the photo-interrupter, although it may also be referred to as optical in that a photo-coupler is used, it is provided with light emitting and light receiving elements within a short distance, and moreover, can surely detect even a very small amount of light when shielded by a black material that is not susceptible to reflection. In contrast to this, in an optical sheet sensor, since a shielding medium itself may have high transmissivity or high reflectivity, it is required to secure an amount of light that can be distinguished surely. Therefore, if the amount of light is set low, this is advantageous for the service life of the light emitting element but the dynamic range is narrowed. Thus, it is likely that the medium and stain affect the sensor more adversely and the sensor performs wrong detection. As a measure for coping with this problem, conventional means is used which adjusts an amount of emitted light of a reflective optical sensor when a main power source of an image forming apparatus is inputted to make an output voltage constant.

For example, when the main power source is inputted, if adjustment of an amount of light of the light emitting element is performed in a state in which a sheet is present at a detection position of the reflective optical sheet sensor, light received by the light receiving element becomes reflected light from the sheet. Since an amount of this reflected light is small, the amount of light of the light emitting element is increased more than necessary in order to keep the amount of the reflected light at a predetermined value. As a result, an electric current flowing to the light emitting element becomes excessive, which is a cause of decreasing the service life of the element.

In addition, in a method of adjusting an amount of light only at the time of input of the main power source for coping with deterioration of characteristics during the operation of the reflective optical sheet sensor, an interval of the adjustment is too long and the adjustment may be insufficient in a high-speed machine that prints a large number of sheets. That is, because a large amount of printing is executed particularly in a high-speed image forming apparatus since the main power source is inputted until the power source is cut off and the next power source is inputted, sheet powder generated during the conveyance of sheets accumulates on the light emitting element and the light receiving element of the reflective optical sheet sensor. As a result, accuracy of detecting sheets falls, which may become a cause of wrong detection of jam.

Moreover, assuming that a system for adjusting an amount of light before and after a job is employed, if the number of sheets to be printed in one job is too many, sheet powder generated during the conveyance of the sheets accumulates on the light emitting element and the light receiving element of the reflective optical sheet sensor in the same manner as described above. As a result, accuracy of detecting sheets falls, which may become a cause of wrong detection of jam.

Further, since adjustment of all optical sheet sensors is always performed, the adjustment takes a relatively long time in an apparatus having a plurality of optical sheet sensors.

SUMMARY OF THE INVENTION

According to an embodiment of the present invention, there is provided an image forming apparatus including:

a sheet containing section for containing sheets;

a conveying member and a conveying path for conveying the sheets;

at least one optical sensor that is arranged in the conveying path and has a light emitting element and a light receiving element for detecting presence or absence of a sheet on the conveying path; and a driver for changing an amount of emitted light of the optical sensor, in which the apparatus includes:

a sheet supply detecting means for detecting a supply operation of the sheets contained in the sheet containing section; and a control section for adjusting an amount of emitted light of the optical sensor according to an output of the sheet supply detecting means.

According to another embodiment of the present invention, there is provided an image forming apparatus including:

a sheet containing section for containing sheets;

a conveying member and a conveying path for conveying the sheets;

at least one optical sensor that is arranged in the conveying path and has a light emitting element and a light receiving element for detecting presence or absence of a sheet on the conveying path; and a driver for changing an amount of emitted light of the optical sensor, in which the apparatus includes:

a counter for counting sheets every time a sheet passes through the optical sensor; and a control section for adjusting an amount of emitted light of the optical sensor according to judgment on whether a value of the counter reaches a predetermined value.

According to still another embodiment of the present invention, there is provided an image forming apparatus including:

a sheet containing section for containing sheets;

a conveying member and a conveying path for conveying the sheets;

at least one optical sensor that is arranged in the conveying path and has a light emitting element and a light receiving element for detecting presence or absence of a sheet on the conveying path;

a driver for changing an amount of emitted light of the optical sensor; and a control section for judging whether or not an amount of emitted light of the optical sensor is adjusted, and for, even with the judgement that the amount of emitted light of the optical sensor is to be adjusted, stopping the adjustment of the amount of emitted light of the optical sensor in the case where the optical sensor detects presence of a sheet on the sheet conveying path.

The other objects and features of the present invention will be apparent from the following description and drawings.

BRIEF DESCRIPTION OF THE DRAWINGS

FIG. 9 is a table showing an example of sensors that should be subjected to flash control at supply of sheets;

FIG. 14 is a table showing an example of sensors that should be subjected to flash control at supply of sheets.

DESCRIPTION OF THE PREFERRED EMBODIMENTS

Figure 1:
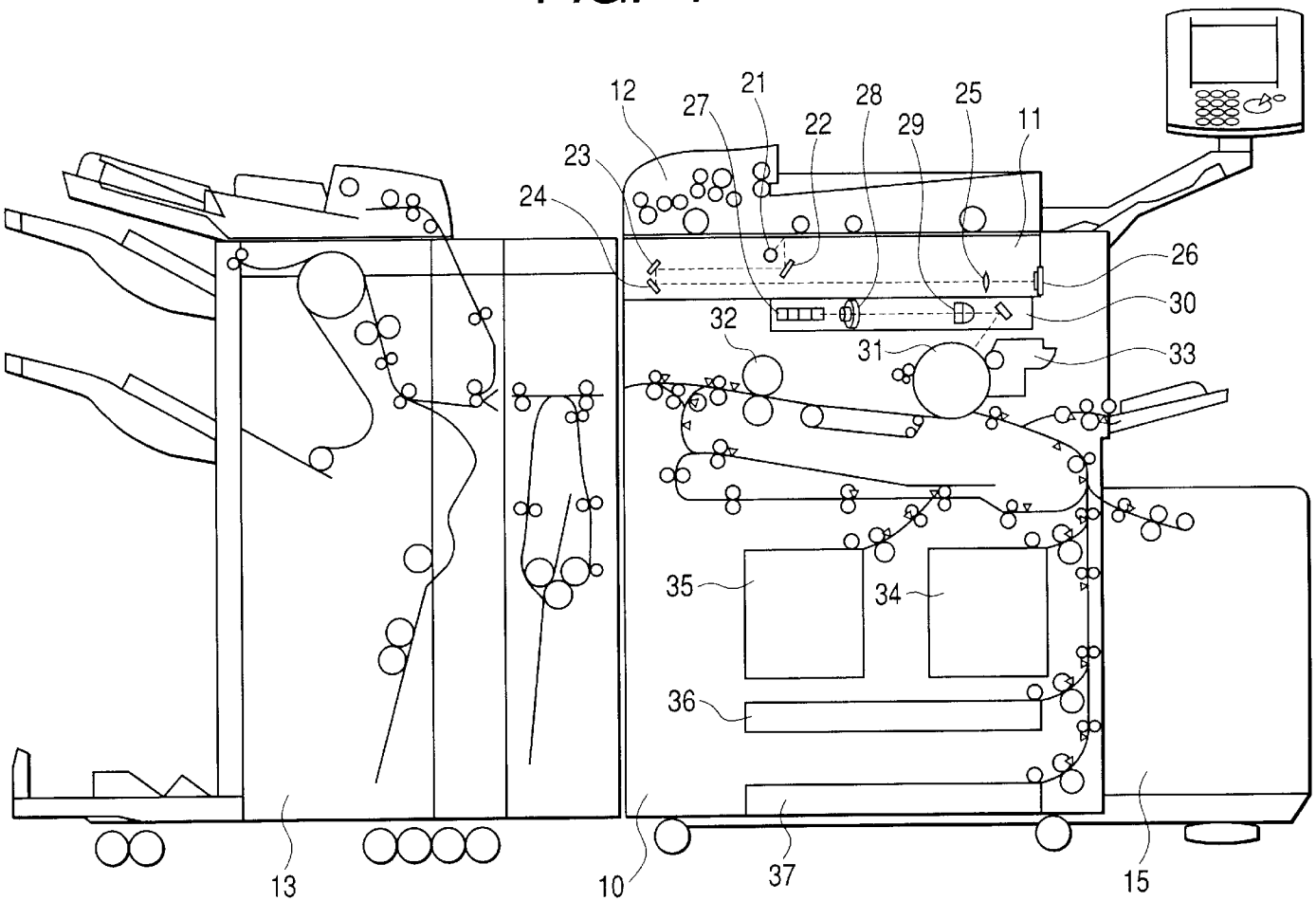
FIG. 1 is a schematic view showing an entire image forming apparatus in which a reflective optical sheet sensor is used.

Embodiments of the present invention will be hereinafter described more specifically based on the accompanying drawings, in which like reference characters designate the same or similar parts throughout the figures thereof.

First Embodiment

FIG. 1 shows an internal structure of an image forming apparatus to which the present invention is applied.

In this image forming apparatus, a plurality of sheet feeding sections (34, 35, 36 and 37) are arranged, which are provided with a reflective optical detecting mechanism capable of adjusting an amount of emitted light as means for judging presence or absence of a sheet, and a large capacity sheet feeding device 15 is mounted.

As shown in FIG. 1, the image forming apparatus of this embodiment is provided with a main body image output section 10 for outputting an original image onto a recording sheet, a main body image input section 11 for reading data of the original image, and an automatic original feeding device 12 above the main body image input section 11.

In the main body image input section 11, light is irradiated on an original placed on an original stand on the upper surface of the input section from a light source 21 for scanning the original in a horizontal direction of FIG. 1. The light is reflected by the original and an optical image is formed on a CCD 26 through mirrors 22, 23 and 24 and a lens 25. In the CCD 26, the formed image is converted into an electric signal and becomes digital image data. The image data is subjected to image conversion according to a request of a user and stored in an image memory.

When the image is outputted, the image data stored in the image memory is read out in the main body image output section 10. The digital signal of the image data is converted back into an analog signal, and the analog signal is irradiated on a photosensitive drum 31 as a light signal of a laser beam from an optical irradiation section 27 via a scanner 28, a lens 29 and a mirror 30 to scan the surface of the photosensitive drum 31. In this way, an electrostatic latent image corresponding to the original image is formed on the photosensitive drum 31. Next, toner is put on the electrostatic latent image by a developing device 33 to form a toner image, which is transferred onto a recording sheet conveyed through the inside of the main body. Then, the toner image on the recording sheet is fixed by a fixing roller 32. Thereafter, the recording sheet is discharged to the outside of the main body image output section 10 and is subjected to post processing such as stapling and bookbinding in a post processing device 13 in accordance with a request of a user.

Figure 2:
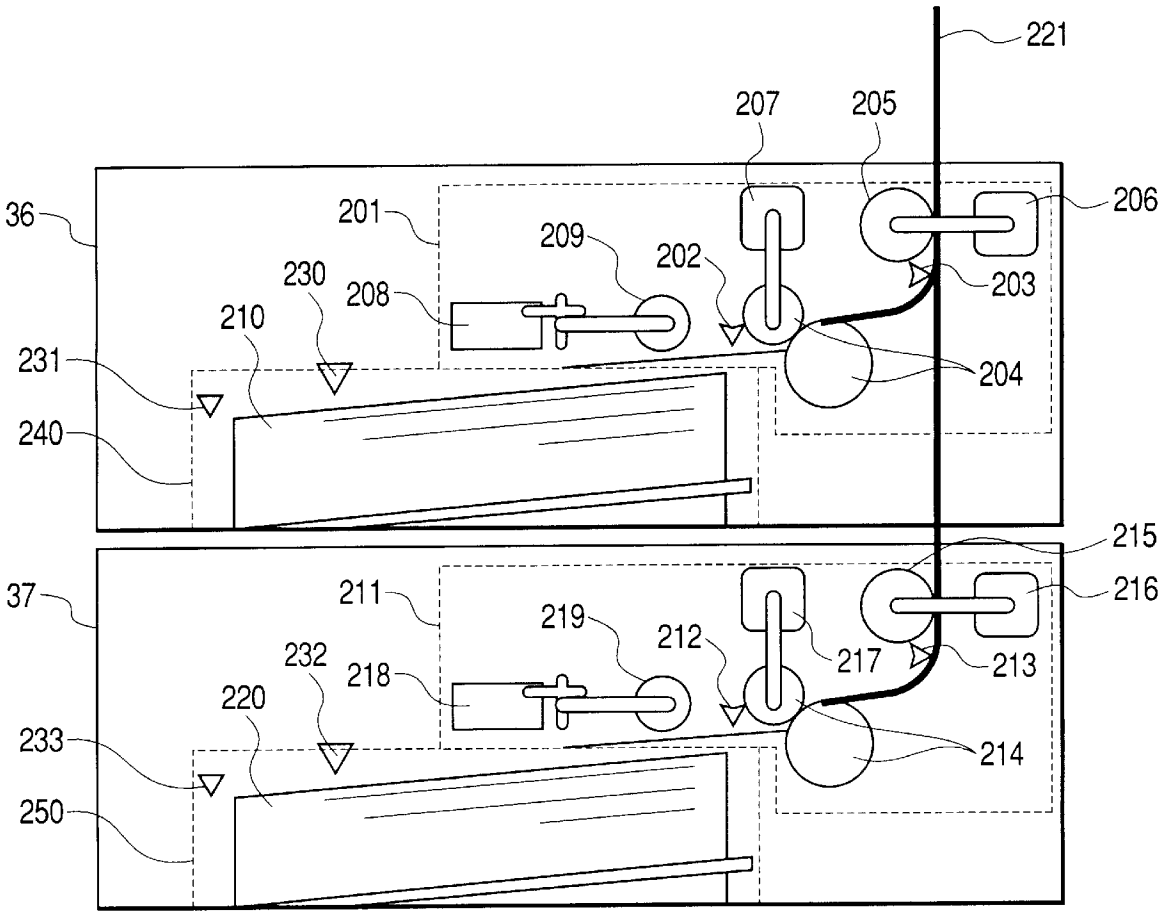
FIG. 2 is an enlarged view of a sheet feeding section of the image forming apparatus of FIG. 1 in which the reflective optical sheet sensor is used.

Next, a recording sheet feeding system will be described. FIG. 2 is an enlarged view of the sheet feeding sections 36 and 37 of FIG. 1. The sheet feeding section 36 is mounted with a sheet feeding unit 201 that includes a sheet feeding roller 204 functioning as a sheet conveying member, a sheet feeding clutch 207, a pulling-out roller 205, a pulling-out clutch 206, a pickup solenoid 208 and a pickup roller 209 as well as a sheet conveying path 221 and reflective optical sheet sensors 202 and 203. The sheet feeding section 37 is also mounted with a sheet feeding unit 211 that is the same as the sheet feeding unit 201 in the sheet feeding section 36.

In supplying a sheet, first, the pickup solenoid 208 is turned off and the pickup roller 209 is lowered to bump against recording sheets 210. Then, the pickup roller 209 is rotated to start sheet feeding.

Then, a sheet feeding motor is turned on, and the sheet feeding clutch 207 transmits power of the sheet feeding motor to the sheet feeding roller 204 in response to a sheet feeding timing signal sent from a controller. At this point, the recording sheets 210 are fed one by one by a difference of frictional forces of the sheet feeding roller 204 and a second sheet from the top, and the reflective optical sheet sensor 202 is turned off to detect presence of a sheet. Moreover, the sheet is conveyed to the sheet conveying path 221 toward the pulling-out roller 205.

The pickup solenoid 208 is turned on at timing of a fixed time after the reflective optical sheet sensor 202 is turned off, and lifts the pickup roller 209 to prevent the second and subsequent sheets from being fed continuously. The sheet feeding clutch 207 is turned off at fixed timing in response to detection signals of the reflective optical sheet sensors 202 and 203. In addition, the reflective optical sheet sensor 203 is provided ahead of the reflective optical sheet sensor 202 beyond the sheet feeding roller 204. Both the reflective optical sheet sensors 202 and 203 detect presence or absence of a sheet, thereby detecting timing at the time of continuous sheet feeding, and at the same time, are used as means for detecting jam or the like.

When the sheet feeding operation of the first sheet is completed, the pickup solenoid 208 is turned off and again lowers the pickup roller 209 and prepares for feed of the next sheet. The pickup solenoid 208 turns on the sheet feeding clutch 207 again and performs the same operation when the second and subsequent sheets are fed.

In general, sheet jam includes two kinds of jam, namely, delay jam and holdup jam. The delay jam is jam judged by a CPU 401 to have occurred if a sheet is not detected by the next reflective optical sheet sensor 203 within a fixed time after it is fed from a sheet feeding cassette 250 and detected by a reflective optical sheet sensor 213. That is, the CPU 401 judges that the delay jam has occurred when a sheet that should reach a reflective optical sheet sensor on a downstream side is not detected by the reflective optical sheet sensor within a time, which is found by adding a margin for slip of the sheet to a conveying time calculated from a conveying speed of the sheet and a distance between the two reflective optical sheet sensors in a positional relationship of upstream and downstream sides of the sheet conveying path, after the reflective optical sheet sensor on the upstream side has detected the sheet.

The holdup jam will be hereinafter described. When a sheet is fed from a sheet cassette 240, the reflective optical sheet sensor 202 is turned off to detect a leading end of the sheet, and subsequently, the reflective optical sheet sensor 203 is turned off to detect the leading end of the sheet. Then, if a reflective optical sheet sensor 212 remains in a state in which it has detected the sheet even if the fixed time has elapsed, the CPU 401 judges that holdup jam has occurred. That is, if the reflective optical sheet sensor remains detecting a sheet within a time, which is found by adding a time taking slip into account to a time in which a trailing end of the sheet would pass the reflective optical sheet sensor since a leading end of the sheet has been detected, after the reflective optical sheet sensor has detected the leading end of the sheet, the CPU 401 judges that holdup jam has occurred.

In addition, if a reflective optical sheet sensor on a sheet conveying path remains detecting a sheet after a fixed time (e.g., two seconds) after it has detected the sheet when a power source is on, the CPU 401 judges that this is also holdup jam.

However, the reflective optical sheet sensor that detects a sheet first after the sheet has been fed from a sheet cassette is not regarded as an object for detecting holdup jam. A reason for this will be hereinafter described.

In the sheet cassette 240, sheets are doubly fed by the pickup roller 209 and two sheets are detected by the reflective optical sheet sensor 202. Then, one of the doubly fed sheets is separated by the sheet feeding roller 204 and is fed toward the pulling-out roller 205. Here, the other sheet remains detected by the reflective optical sheet sensor 202. The CPU 401 usually judges that holdup jam has occurred. However, the sheets are fed one by one and neither affects image formation at all nor affects the next sheet feeding, it is unnecessary to judge that jam has occurred to suspend printing. Therefore, the reflective optical sheet sensor that detects a sheet first after the sheet has been fed from the sheet cassette is not regarded as the object for detecting holdup jam.

This is the same when the power source is on. The sheets are doubly fed and the other sheet may be present in the position of the reflective optical sheet sensor 202 at the last feeding before the power source is turned off. The CPU 401 does not judge that this is holdup jam when the power source is on.

In FIG. 2, reference numerals 230 and 232 denote sheet in-cassette sensors for detecting a residual amount and presence or absence of sheets in the sheet cassettes 240 and 250 functioning as sheet containing sections, respectively. When the sensors detect that sheets are absent, the CPU 401 urges a user to supply sheets via a control panel or the like.

The image forming apparatus of this embodiment has an automatic cassette change function that is a function for automatically switching to another sheet cassette containing sheets of the same size when sheets in the sheet cassette currently in use are exhausted. If the sheets in the sheet cassette currently in use are exhausted as described above, and this automatic cassette change function is set and sheets of the same size are present in another sheet cassette, the image forming apparatus utilizes the automatic cassette change function to immediately start sheet feeing from another sheet cassette and continue print output.

The sheet cassettes 240 and 250 functioning as sheet containing sections are sheet cassettes of a front loading type and are structured so as to be drawn out independently from the sheet feeding units 201 and 211, respectively.

In addition, reference numerals 231 and 233 denote cassette sensors for detecting opening and closing of a sheet cassette. When the sensor is off, the cassette is in a pulled-out state, and when the sensor is on, the cassette is normally mounted and in a closed state.

Figure 3B:
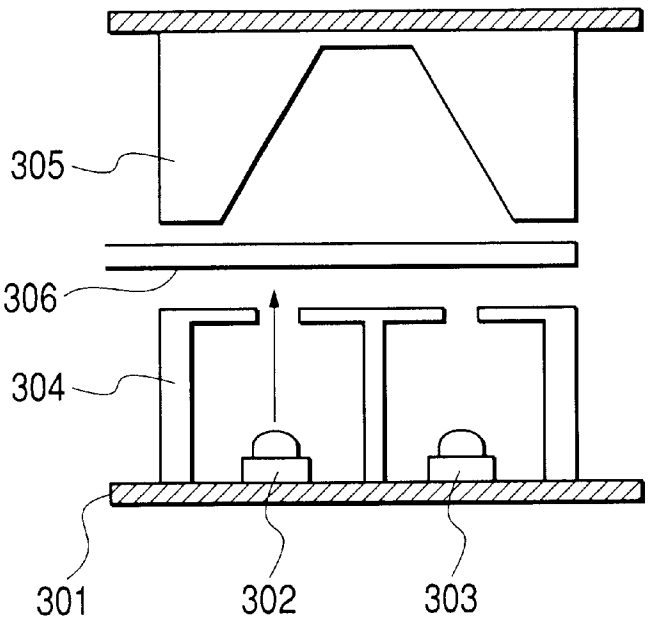
FIGS. 3A and 3B are diagrams showing the inside of the reflective optical sheet sensor including a light emitting element and a light receiving element.
Figure 3A:
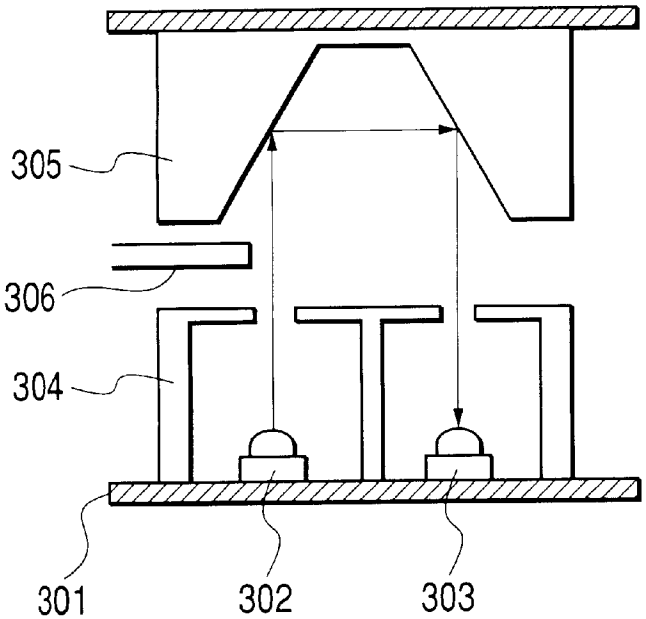

FIGS. 3A and 3B are sectional diagrams of a reflective optical sheet sensor using a prism as a reflection plate that is used in this embodiment. FIG. 3A is a diagram at the time of absence of sheets and FIG. 3B is a diagram at the time of presence of sheets. The structure of the reflective optical sheet sensor is the same when the reflection plate is a mirror. A light emitting element 302 and a light receiving element 303 are mounted on a sensor substrate 301 and are covered by a cover 304.

In this way, the light emitting element and the light receiving element are aligned in a sheet conveying direction and arranged adjacent and in close proximity with each other. A surface area of the sensor in contact with the sheet is larger than that of a sensor in which a light emitting element and a light receiving element are arranged to be opposed each other. Thus, when a sheet is conveyed, paper powder tends to accumulate on the upper surface of the optical sheet sensor which comes into contact with the conveyed sheet and which is in a position where an optical path from the light emitting element to the light receiving element is blocked.

A mirror or a prism 305 is provided opposite the sensor substrate 301. At the time of absence of sheets of FIG. 3A, light emitted from the light emitting element 302 is reflected by the prism 305, and the reflected light is detected by the light receiving element 303.

On the other hand, at the time of presence of sheets shown in FIG. 3B, light from the light emitting element 302 is interrupted by a recording sheet 306. Since reflectivity of the recording sheet 306 is lower than that of the prism 305, an output of the light receiving element 303 is reduced. Thus, presence or absence of a recording sheet can be distinguished by a difference of light receiving intensities.

However, if an electric current is flown to the light emitting element 302 or the light receiving element 303, an amount of emitted light decreases or a light receiving sensitivity falls depending on an amount or a duration of the electric current. Therefore, it is necessary to periodically adjust an electric current of the light emitting element 302 to keep an output of the light receiving element 303 constant. In addition, because the output varies depending on a mechanical inclination at the time of attachment or a difference of sensitivities between the light emitting element 302 and the light receiving element 303, the mechanical inclination and the difference of sensitivities must be adjusted in each reflective optical sheet sensor.

Figure 4:
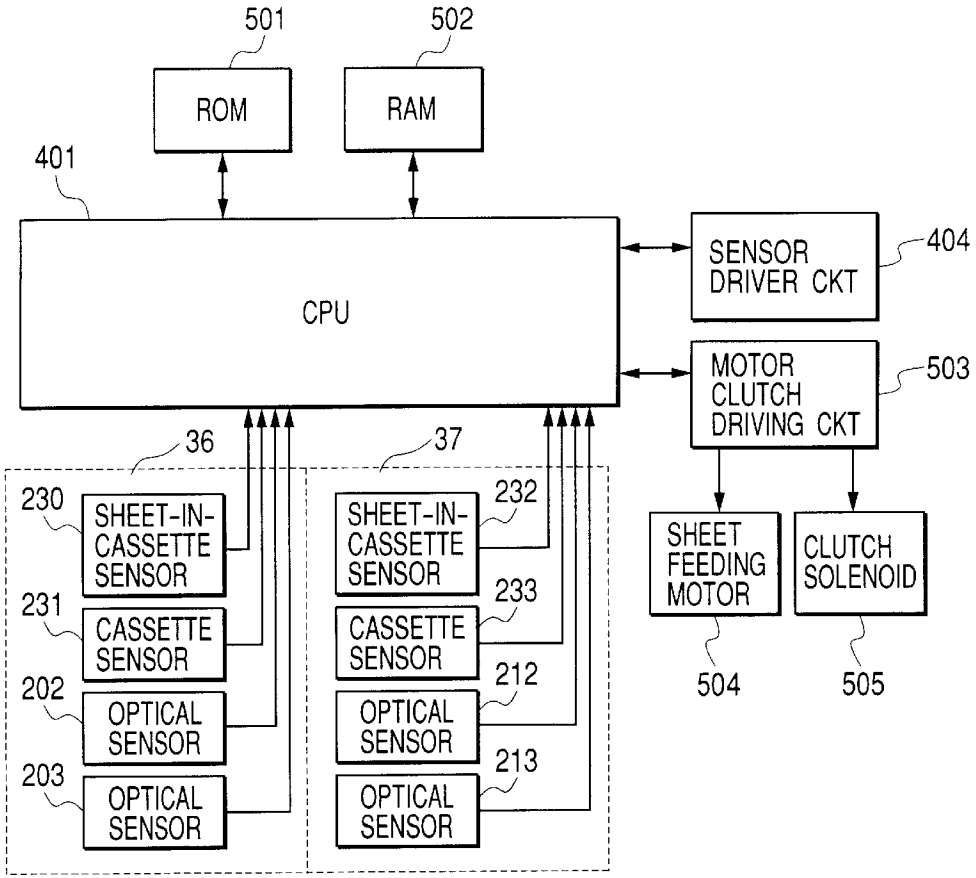
FIG. 4 is a block diagram of a control system for feed and conveyance of sheets of an image forming apparatus in a first embodiment of the present invention.

FIG. 4 is a block diagram of a control system for feed and conveyance of sheets of the image forming apparatus in this embodiment of the present invention. The CPU 401 controls operations of a clutch, pickup solenoid, and the like 505 in the sheet feeding unit 201 and a sheet feeding motor 504 outside the sheet feeding unit 201 and applies flash control (or light control) to the reflective optical sheet sensors 202 and 203. The CPU 401 performs flash control in a driver circuit 404 in applying the flash control to the reflective optical sheet sensors 202 and 203 and performs driving via a motor clutch driving circuit 503 in driving the sheet feeding motor 504 and the clutch, solenoid, and the like 505.

The sheet in-cassette sensors 230 and 232 detect presence or absence of sheets in the sheet cassette, respectively, and the cassette sensors 231 and 233 detect opening or closing of the sheet cassette, respectively.

When these sheet in-cassette sensors 230 and 232 detect that sheets are exhausted during printing, the image forming apparatus urges a user to supply sheets. Then, when sheets are supplied and the cassette sensors 231 and 233 detect that the sheet cassette has been normally mounted, flash control is applied to the reflective optical sheet sensors 202, 203, 212 and 213 to adjust a light receiving level to an output set digital value Dom set in advance.

Figure 5:
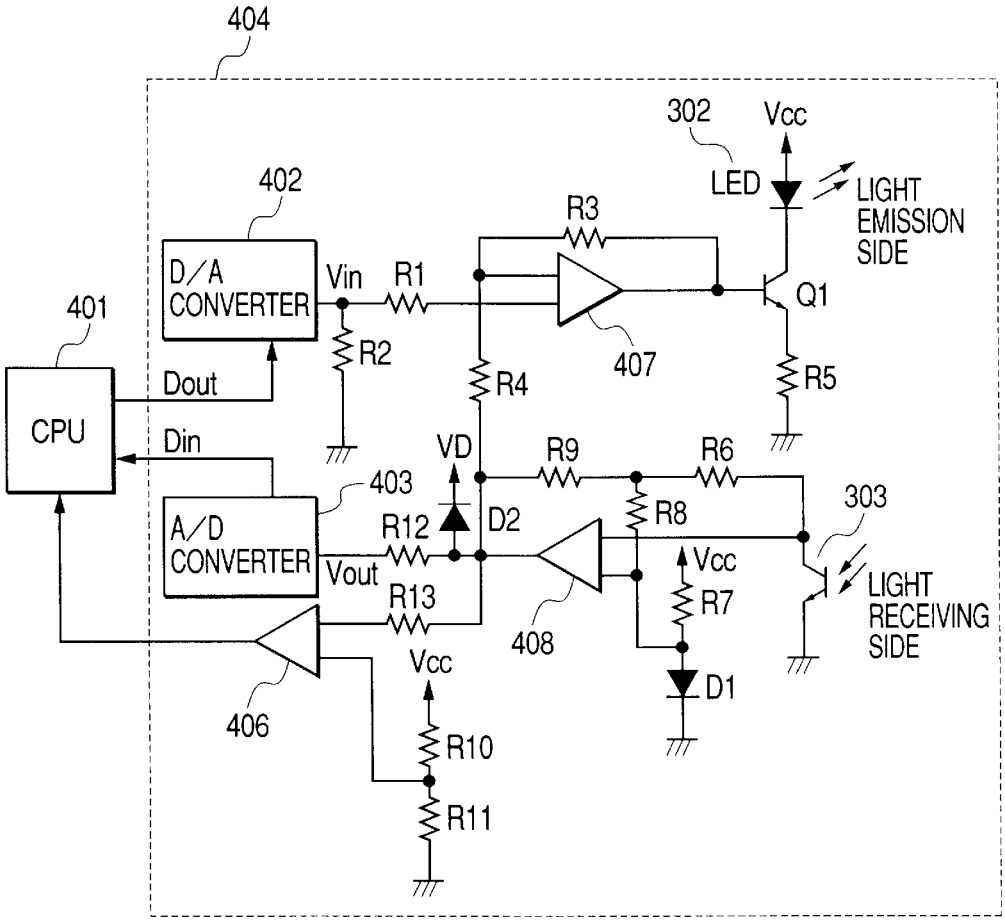
FIG. 5 is a sensor drive circuit diagram of the reflective optical sheet sensor.

FIG. 5 is a diagram showing the sensor driver circuit 404 shown in FIG. 4 in detail.

A digital output value Dout of 8 bits or 16 bits, which is equivalent to a light emitting intensity of the LED 302 functioning as a light emitting element, is outputted from the CPU 401. The digital output value Dout is converted into an input voltage Vin of an analog value by a D/A converter 402. A constant electric current for driving the LED 302 functioning as a light emitting element is outputted by an operation amplifier 407 to drive the LED 302 with the constant electric current. Upon receiving reflected light from the prism 305, the photodiode 303 functioning as a light receiving element flows an electric current that is substantially proportional to a light receiving intensity.

The operation amplifier 408 amplifies an output voltage Vout in order to make an electric current flowing to the photodiode 303 constant. Consequently, a large change in an output is realized even when a change in a light receiving intensity is small. An output of the operation amplifier 408 is branched to an A/D converter 403 and a comparator 406. The comparator 406 compares an output voltage of the operation amplifier 408 and a reference voltage, and the output voltage takes one of two values, a High level or a Low level. Outputs of these two values are used by the CPU 401 to judge whether sheets are present or absent.

On the other hand, a voltage inputted in the A/D converter 403 branched from the output of the operation amplifier 408 is converted into a digital input value Din of 8 bits or 16 bits from an analog value by the A/D converter 403 and inputted in the CPU 401. The CPU 401 adjusts the output digital value Dout so as to adjust the digital input value Din to a flash control level stored in advance at the time of a flash control sequence discussed below.

That is, if an optical path from a light emitting element to a light receiving element is blocked due to the service life, paper power or the like and a light receiving intensity falls, the digital output value Dout is increased. Conversely, if a light receiving intensity after cleaning paper powder or the like becomes larger than that before the cleaning, the output digital value Dout is decreased. By repeating this control until the output digital value Dout is adjusted to a level decided in advance, an output voltage of the reflective optical sheet sensor is kept constant and a stable output is obtained.

Figure 6A:
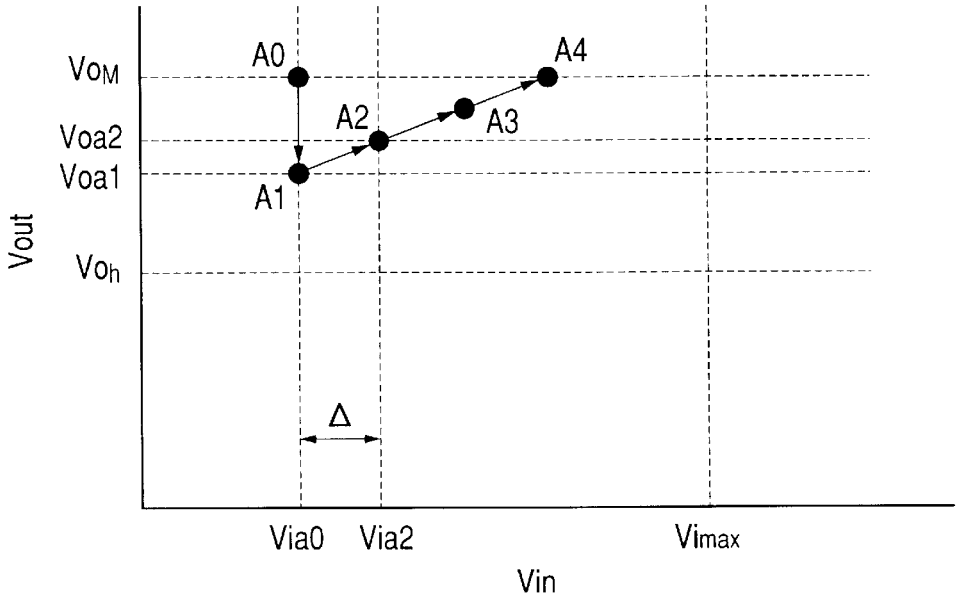
FIGS. 6A and 6B are graphs showing input/output characteristics at the time of adjustment of the reflective optical sheet sensor.
Figure 6B:
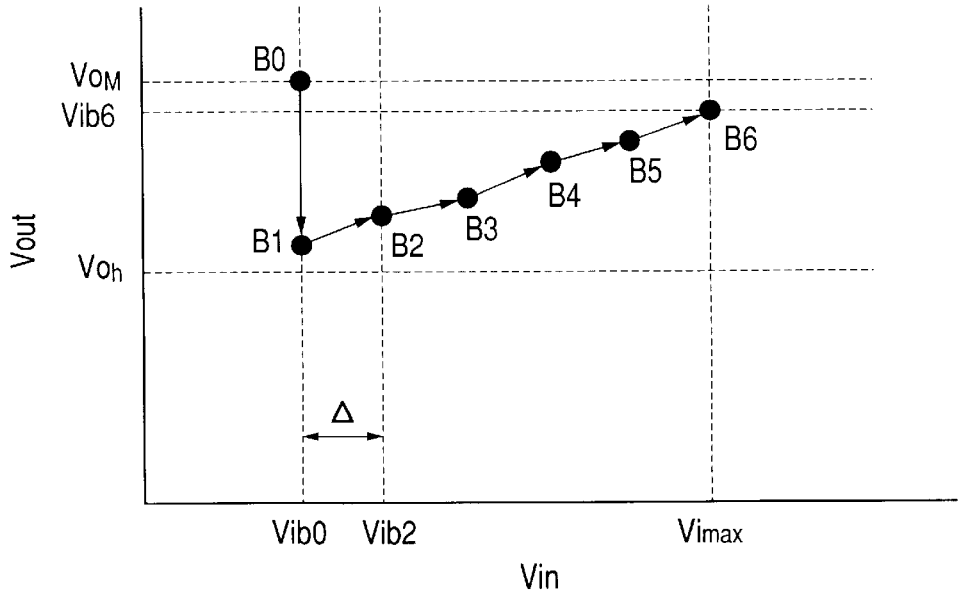

FIGS. 6A and 6B are graphs showing the relationship between an input voltage Vin from the A/D converter 403 to the CPU 401 and an output voltage Vout from the CPU 401 to the D/A converter 402 with respect to the reflective optical sheet sensor. Here, Vimax is a maximum value of a voltage at which the circuit shown in FIG. 5 can output, Voh is a threshold value at which the reflective optical sheet sensor detects presence or absence of recording sheets, and VoM is an output set voltage value of the reflective optical sheet sensor set in advance. When the image forming apparatus is shipped, at a point A0 where an output voltage is equal to VoM, an input voltage corresponding to the output voltage is Via0. In FIG. 6A, it is assumed that the image forming apparatus is used by a user and its state falls to A1 due to the influence of the service life, paper powder or the like. At this point, if adjustment of an amount of emitted light is performed, the CPU 401 shown in FIG. 5 increases the input value by an input value Δ decided in advance. This value of Δ may be a fixed value or a value calculated taking into account an amount of decrease in the output from A0 to A1. However, since the adjustment takes long if Δ is set at a small value, it is desirably an appropriate value that is set taking into account an adjustment time and an accuracy.

When the input is increased by Δ to be set at Via2, the output becomes Voa2. Since VoM>Voa2, the input voltage is increased by Δ again. This is repeated until the output voltage becomes VoM or more (A4), at which point the adjustment is finished and the input voltage is set at Via4. On the other hand, in the case where VoM>Vob6 even if the input voltage is increased to Vimax as shown in FIG. 6B, the sensor regards that attenuation due to paper powder has occurred or the service life is fulfilled, and notifies a user to clean or replace the sensor.

Figure 7:
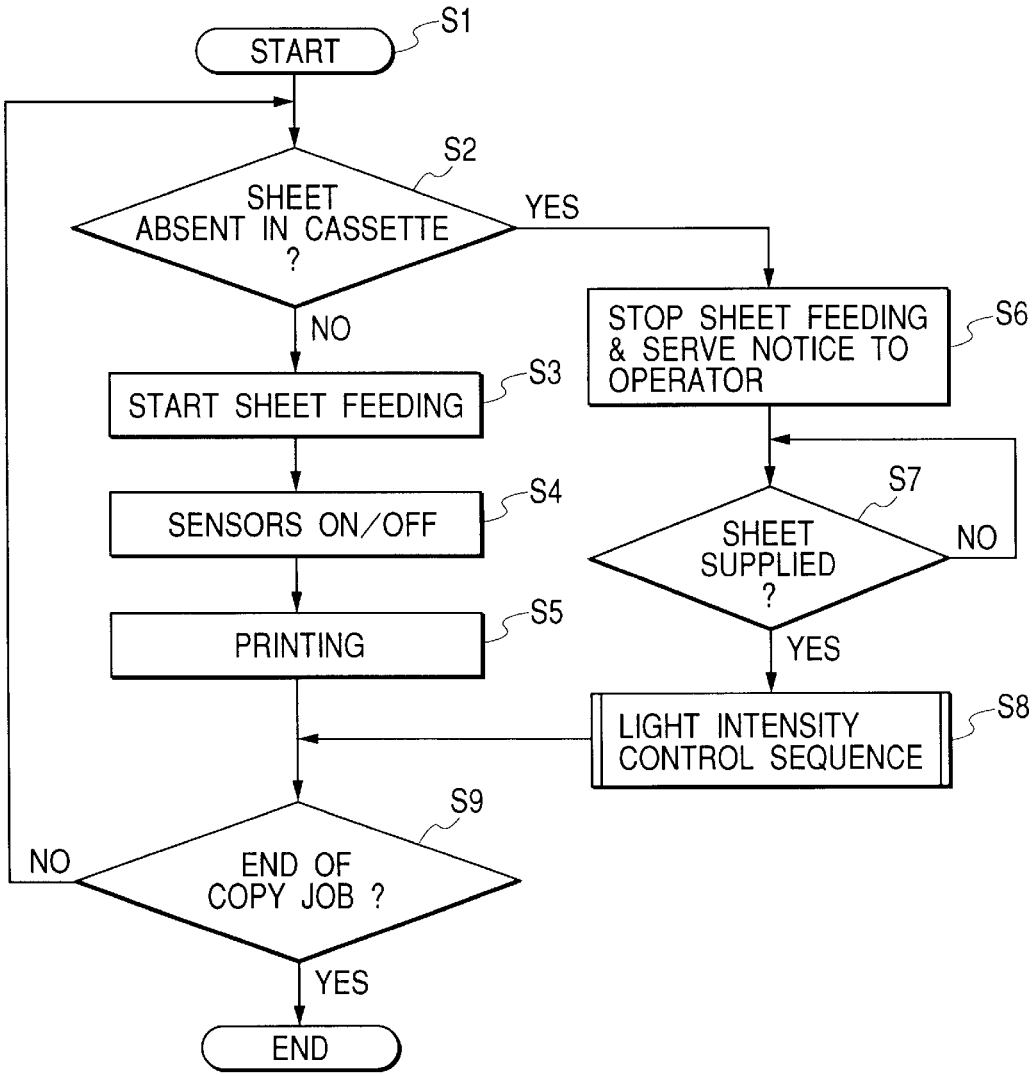
FIG. 7 is a flow chart concerning a flash control operation.

FIG. 7 is a flow chart concerning a flash control operation (or light control operation) by the CPU 401 of the reflective optical sheet sensor in the case in which the image forming apparatus supplies sheets during printing. A control program in accordance with this flow chart is written in an internal memory of the CPU 401.

When the user starts copying from a control unit or the like (S1), the CPU 401 detects presence or absence of sheets in a sheet cassette designated by the user or by automatic cassette change (S2). Then, if sheets are present in the sheet cassette, the CPU 401 starts sheet feeding such as rotating a sheet feeding motor 504 (S3). As described above with reference to FIG. 2, at this point, the reflective optical sheet sensor 202 detects a conveyed sheet to be turned off, and thereafter, the reflective optical sheet sensor 203 is also turned off (S4). Then, the CPU 401 performs printing (S5), judges whether a copy job has ended (S9), and ends copying (S10) if the copy job has ended. If the copy job has not ended, the CPU 401 returns to S2 and performs copying of the next recording sheet.

If it is judged that sheets are absent in the cassette in S2, the CPU 401 stops sheet feeding and urges the user to supply sheets (S6). Here, if there are sheets of the same size in another sheet cassette, feeding of the sheets from another sheet cassette is started by an automatic cassette change function and printing is continued. That is, the flow of FIG. 7 is started in the same manner in another sheet cassette.

Then, when the user supplies sheets, the sheet cassette is drawn out, the sheets are supplied to the sheet cassette, and the sheet cassette is normally mounted. If transition from a state of absence of sheets to a state of presence of sheets is detected by the sheet in-cassette sensors 230, 232 and the like, and at the same time, transition from a state in which the sheet cassette is drawn out to a state in which the sheet cassette is normally mounted is detected by the cassette sensors 231, 233 and the like, the CPU 401 regards that the sheet supply has been completed (S7). At the timing when the sheet supply has been completed, the CPU 401 starts a flash control sequence and adjusts an amount of emitted light of the sensor 202, the sensor 203 or the like functioning as a reflective optical sheet detecting mechanism (S8).

Here, the timing for starting the flash control is not limited to the above-described embodiment but may be, for example, a point when only the transition from the state of absence of sheets to the state of presence of sheets in the sheet cassette is detected. In this case, since it is meaningless to control flash when there is no sheet in the sheet cassette, it is desirable to perform the real time flash control at timing when sheet supply is possible.

In addition, regardless of presence or absence of supply of sheets in the sheet cassette, the timing may be a point when the cassette sensors 231, 233 and the like detect only the transition from the state in which the sheet cassette is drawn out to the state in which the sheet cassette is normally mounted. In this case, since flash is controlled even in the state in which sheets are supplied while sheets still remains in the sheet cassette, the flash can be controlled at appropriate timing even if sheets are continuously supplied and used before the sheet cassette comes to be in the state of absence of sheets.

Moreover, regardless of presence or absence of supply of sheets to the sheet cassette, the flash control may be immediately started in the state in which the sheet cassette is drawn out. In this case, in particular, there is an advantage in that printing can be started immediately after mounting the sheet cassette because the flash control has already been completed in most cases by the time when the sheet cassette is mounted.

Figure 8:
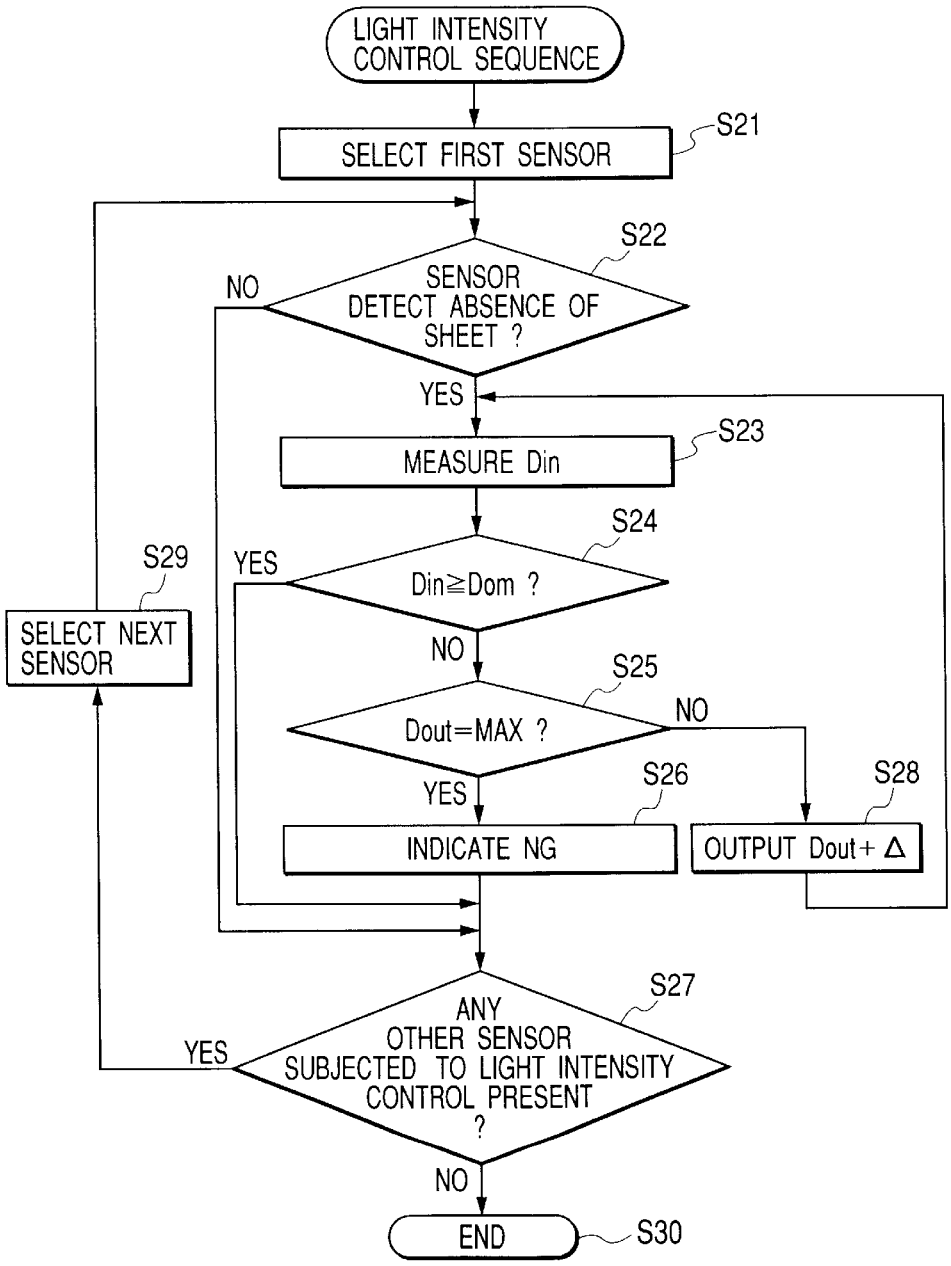
FIG. 8 is a flow chart of a flash control sequence of the reflective optical sheet sensor in the first embodiment of the present invention.

FIG. 8 is a flow chart in which the flash control sequence by the CPU 401 of S8 is described in detail. In this flash control sequence, in the case in which flash control is applied to a plurality of sensors attached to an identical unit, when instructed to start the flash control, the CPU 401 selects a first sensor (S21) and checks if the sensor detects a sheet (S22). A state in which the sensor has detected a sheet is a state in which an optical sensor detects a sheet that is being fed or detects a jammed sheet on the sensor, or a reflective optical sheet sensor that first detects a sheet fed from the sheet cassette is held up. In this case, since the flash control cannot be performed, the CPU 401 advances to S27 to move to the flash control of the next sensor.

When the sensor does not detect a sheet, the CPU 401 measures a digital input value Din of the A/D converter 403 which corresponds to a current amount of received light (S23) and compares the digital input value Din and the output set digital value Dom equivalent to the output set voltage value Vom (S24). If the digital input value Din and the output set digital value Dom are different, the CPU 401 judges if the digital output value Dout equivalent to a current LED electric current to be outputted from the D/A converter 402 is a maximum value equivalent to Vimax that can be set (S25), and if it is the maximum value, the CPU 401 indicates NG (S26) to inform the user that the sensor is unadjustable and moves to S27.

If the digital output value Dout is not the maximum value that can be set, the CPU 401 outputs a value found by adding a fixed value Δ to the current digital output value Dout (S28) and measures the digital input value Din on the light receiving side again (S23). This control is repeated until the digital input value Din of the amount of received light becomes the output set digital value Dom or more, and when it becomes the output set digital value Dom or more, the CPU 401 sets the digital output value Dout as a light emitting output of the sensor, checks if there is any other sensor to be subjected to flash control (S27) next, and if there is such a sensor, selects the sensor (S29) to perform the same flash control. When the flash control of all the sensors is completed, the CPU 401 ends the flash control sequence (S30).

FIG. 9 is a table showing an example of sensors that should be subjected to flash control when sheets are supplied to the sheet cassette. Cases of FIG. 9 in which a sensor that should be subjected to flash control is decided will be described specifically with reference to FIG. 2.

(Case 1)

When sheets are supplied to the sheet cassette 250 of the sheet feeding section 37 and the sheet cassette is normally mounted in the state in which the sheet cassette 240 of the sheet feeding section 36 of FIG. 2 is executing a job and is performing continues sheet feeding, the sensors 202 and 203 are used for the continuous sheet feeding and cannot be subjected to flash control, so that the sensors 212 and 213 are subjected to the flash control.

(Case 2)

When: sheet feeding of the sheet feeding section 36 of FIG. 2 is suspended; sheets are supplied to the sheet cassette 250 of the sheet feeding section 37; and the sheet cassette is normally mounted, there is a large loss of time since the cassette has been mounted if all the sensors are subjected to flash control, so that the sensors 203, 212 and 213, which are used by the mounted sheet cassette for sheet feeding, are subjected to the flash control.

(Case 3)

When sheets are supplied to the sheet cassette 240 of the sheet feeding section 36 and the sheet cassette is normally mounted in the state in which the sheet cassette 250 of the sheet feeding section 37 of FIG. 2 is executing a job and is performing continues sheet feeding, the sensors 203, 212 and 213 are used for the continuous sheet feeding and cannot be subjected to the flash control, so that the sensor 202 is subjected to the flash control.

(Case 4)

When: sheet feeding of the sheet feeding section 37 of FIG. 2 is suspended; sheets are supplied to the sheet cassette 240 of the sheet feeding section 36; and the sheet cassette is normally mounted, there is a large loss of time since the cassette has been mounted if all the sensors are subjected to flash control, so that the sensors 203 and 203, which are used by the mounted sheet cassette for sheet feeding, are subjected to the flash control.

In the above-described cases, sensors that are used in the case in which sheets are supplied to a sheet cassette and the sheets are fed, or in particular, sensors that require flash control among the sensors are subjected to the flash control. Moreover, even in the case in which sheets are continuously fed from a separate sheet feeding section, among sensors that are used in the case in which sheets are supplied and the sheets are fed, sensors are subjected to the flash control as long as the sensors require the flash control and can be subjected to the flash control. Consequently, it becomes possible to perform stable sheet conveyance in which sheet jam is not detected by mistake. Moreover, even while an automatic cassette change function is operating or during continuous sheet feeding from another sheet cassette, a copy job can be prevented from being stopped in the middle for flash control, resulting in reduction of downtime.

In addition, the above-described cases of FIG. 9 are not limited to these, and for example, an optical sensor that requires flash control changes depending on a structure of a sheet feeding section, an arrangement of optical sensors, or the like.

In the image forming apparatus of this embodiment, the flash control sequence shown in FIG. 8 is also performed when a main power source of the image forming apparatus is inputted or before and after every copy job. In this case, the flash control sequence is applied to all reflective optical detecting mechanisms arranged in the image forming apparatus, whereby the number of times a copy job is stopped in the middle can be reduced, and stable sheet conveyance can be performed even while a large amount of copying is being performed. Further, although only the image forming apparatus with the optical sensors arranged in the sheet feeding sections is shown in this embodiment, the image forming apparatus of the present invention is not limited to this. For example, the present invention may be applied to an image forming apparatus with optical sensors arranged in a sheet discharging section, a finisher, or a both-side path.

Second Embodiment

The image forming apparatus of the first embodiment executes a flash control operation by an output of a sheet supply operation detecting means, whereas an image forming apparatus of a second embodiment executes a flash control operation according to a judgment on whether a value of a counter counted every time a sheet passes an optical sensor has reached a predetermined value. Therefore, descriptions concerning FIGS. 1, 2, 3A, 3B, 5, 6A, 6B and 8 are omitted because the figures or the detailed description with reference to the figures are the same as those in the first embodiment.

Figure 10:
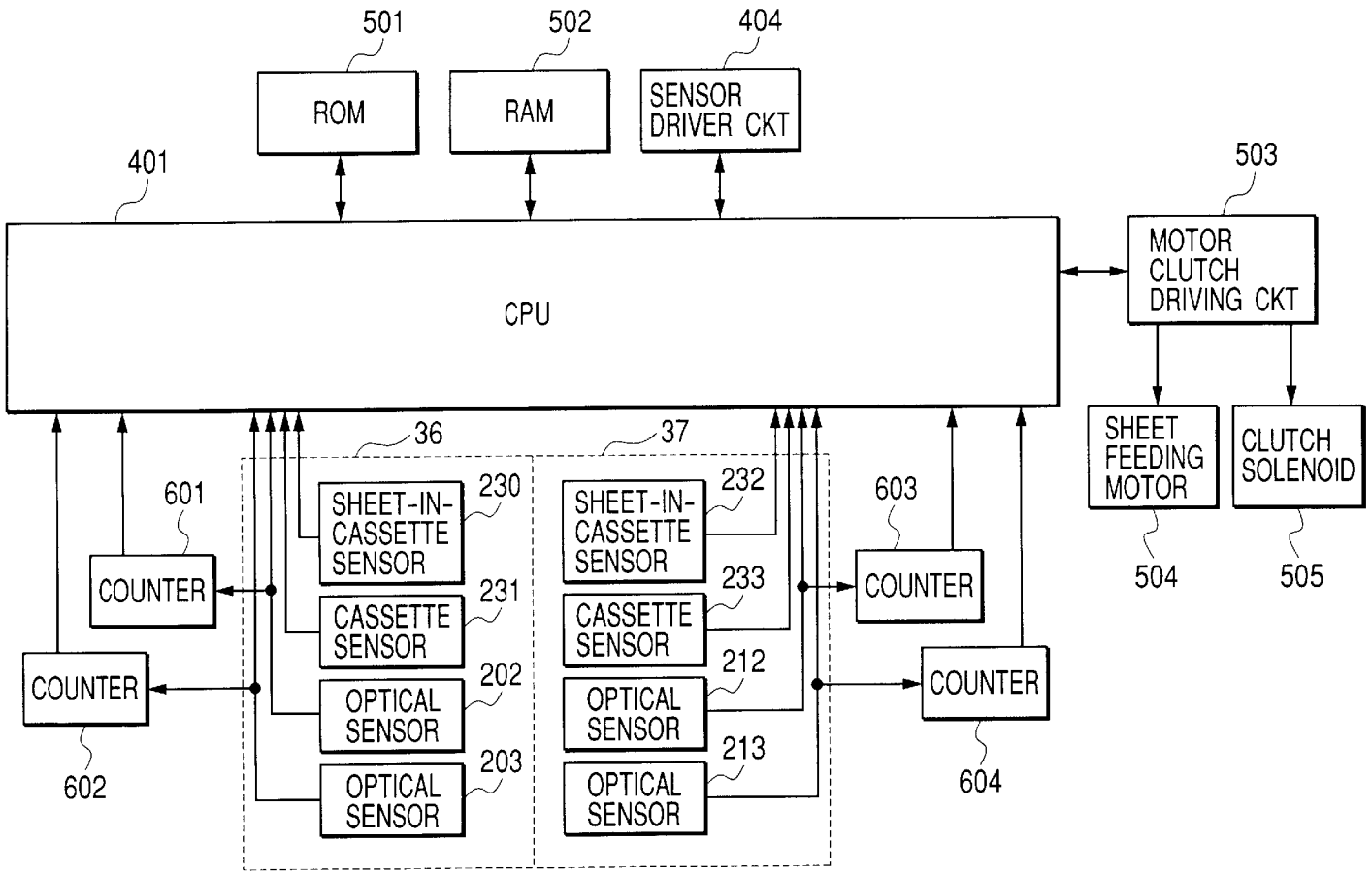
FIG. 10 is a block diagram of a control system for feed and conveyance of sheets of an image forming apparatus in a second embodiment of the present invention.

FIG. 10 is a block diagram of a control system for feed and conveyance of sheets of the image forming apparatus in the second embodiment. The CPU 401 controls operations of a clutch, pickup solenoid, and the like 505 in the sheet feeding unit 201 and a sheet feeding motor 504 outside the sheet feeding unit 201 and applies flash control to the reflective optical sheet sensors 202, 203, 212 and 213. The CPU 401 performs flash control in the driver circuit 404 in applying flash control to the reflective optical sheet sensors 202, 203, 212 and 213 and performs driving via a motor clutch driving circuit 503 in driving the sheet feeding motor 504 and the clutch, solenoid, and the like 505.

Counters 601, 602, 603 and 604 count the number of times the reflective optical sheet sensors 202, 203, 212 and 213 are turned off and sheets are detected, respectively. The counters 601, 602, 603 and 604 may be arranged in the CPU 401 in advance or may be provided outside the CPU 401. A counter value is stored by a non-volatile RAM 501, and outputs of turning off the reflective optical sheet sensors 202, 203, 212 and 213 are stored as the total count number of sheets. A fixed count value, which is calculated from values of durable time and an amount of paper powder measured in advance, is set in an ROM 502. The CPU 401 suspends sheet feeding when the count values of the counters 601 to 604 become the same as the set value, and applies flash control to the reflective optical sheet sensors 202, 203, 212 and 213 to adjust a light receiving level to the output set digital value Dom set in advance.

The sheet in-cassette sensors 230 and 232 detect presence or absence of sheets in the sheet cassette, respectively, and the cassette sensors 231 and 233 detect opening or closing of the sheet cassette, respectively.

Figure 11:
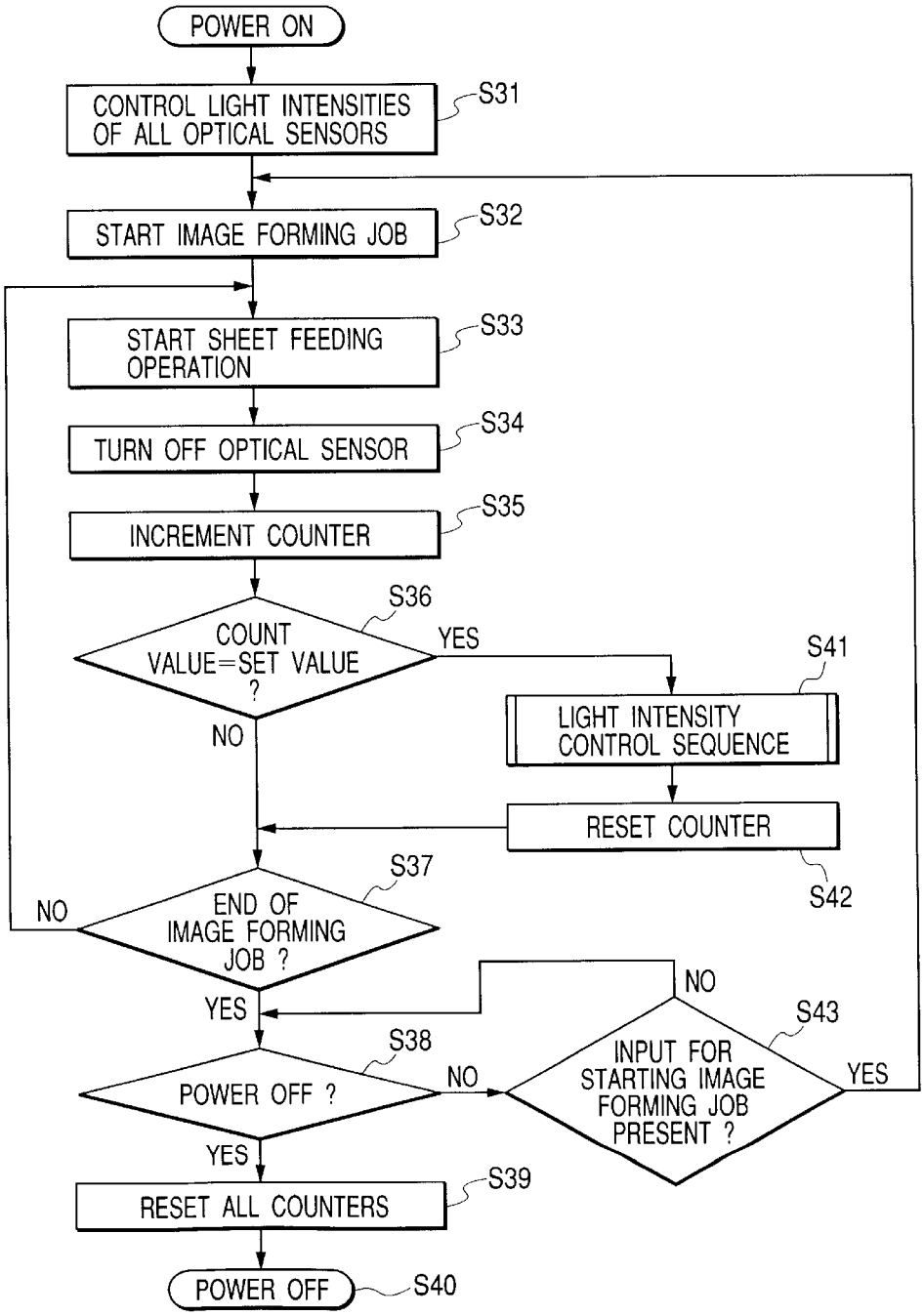
FIG. 11 is a flow chart concerning a flash control sequence of a reflective optical sheet sensor in the second embodiment of the present invention.

FIG. 11 is a flow chart of the second embodiment concerning a flash control operation by the CPU 401 of the reflective optical sheet sensor in the case in which the image forming apparatus supplies sheets during printing. A control program in accordance with this flow chart is written in the internal memory of the CPU 401.

When a user turns on a power source, the CPU 401 performs an initial operation required for starting up a printer and flash control of all optical sensors (S31). Then, when the user starts an image forming job from an control unit or the like, the CPU 401 first detects presence or absence of sheets in the sheet cassette designated by the user (S32). If the sheets are present, the CPU 401 starts a sheet feeding operation such as rotating the sheet feeding motor 504 (S33). As described with reference to FIG. 2, at this point, the reflective optical sheet sensor 202 detects a conveyed sheet to be turned off, and thereafter, the reflective optical sheet sensor 203 is also turned off (S34).

Then the CPU 401 increments the counter 601 when the reflective optical sheet sensor 202 is turned on while performing the image forming operation and subsequently increments the counter 602 when the reflective optical sheet sensor 203 is turned on (S35). The count values are stored in the RAM 502 and compared with the fixed count value set in the ROM 501, which is calculated from values of durable time and an amount of paper powder measured in advance (S36).

If the count value stored in the RAM is equal to the count value stored in the ROM, the reflective optical sheet sensor corresponding to the count value executes a flash control sequence, and the image forming operation is suspended for a time required for the flash control (S41). Then, the CPU 401 resets the count value corresponding to the reflective optical sheet sensor that has executed the flash control sequence and returns it to zero (S42).

The CPU 401 judges if the image forming job has ended (S37), and if the image forming job has not ended, returns to S33 and performs an image forming operation of the next recording sheet. If the image forming job has ended, the CPU 401 watches if the power source is turned off (S38). If the power source is not turned off, the CPU 401 watches an input for starting the next image forming job and an input for turning off the power source (S43). If the input for starting the next image forming job is present, the CPU 401 returns to S2, and starts the image forming job. If the input for turning off the power source is present, the CPU 401 resets all the counters of the reflective optical sheet sensor and returns them to zero (S39). Then, the CPU 401 turns off the power source (S40).

Here, in the above-described embodiment, the number of times of turning on the reflective optical sheet sensor is counted up. However, the present invention is not limited to this. The number of times of turning off the reflective optical sheet sensor may be counted, or a set value of the ROM may be registered as a count value of the RAM to be counted down. Moreover, when the set value is counted down to be zero, a flash control flag may be set up to operate a flag check sequence and start a flash control sequence.

In addition, the reset of the counter is executed before turning off the power source in this embodiment. However, the reset of the counter may be executed at the time of the initial operation before controlling light intensities of all optical sensors in S31 after the power source is turned on.

When the flash control sequence is performed in S41 of FIG. 11, the image forming job is stopped. However, the image forming job may not be stopped. In this case, only a flash control operation of a reflective optical sheet sensor unrelated to the image forming job is performed. That is, execution of a flash control operation of a reflective optical sheet sensor in a sheet conveying path currently in use is not started, and the image forming job is continued. Then, after the completion of the image forming job, the flash control operation of the reflective optical sheet sensor may be executed.

Third Embodiment

In a third embodiment, the flash control operation and timing of the flash control operation during the automatic cassette change and the sheet feeding of the second embodiment are described in detail. Descriptions concerning FIGS. 1, 2, 3A, 3B, 5, 6A, 6B, 8 and 10 are omitted because the figures or the detailed description with reference to the figures are the same as those in the first and second embodiments.

Figure 12:
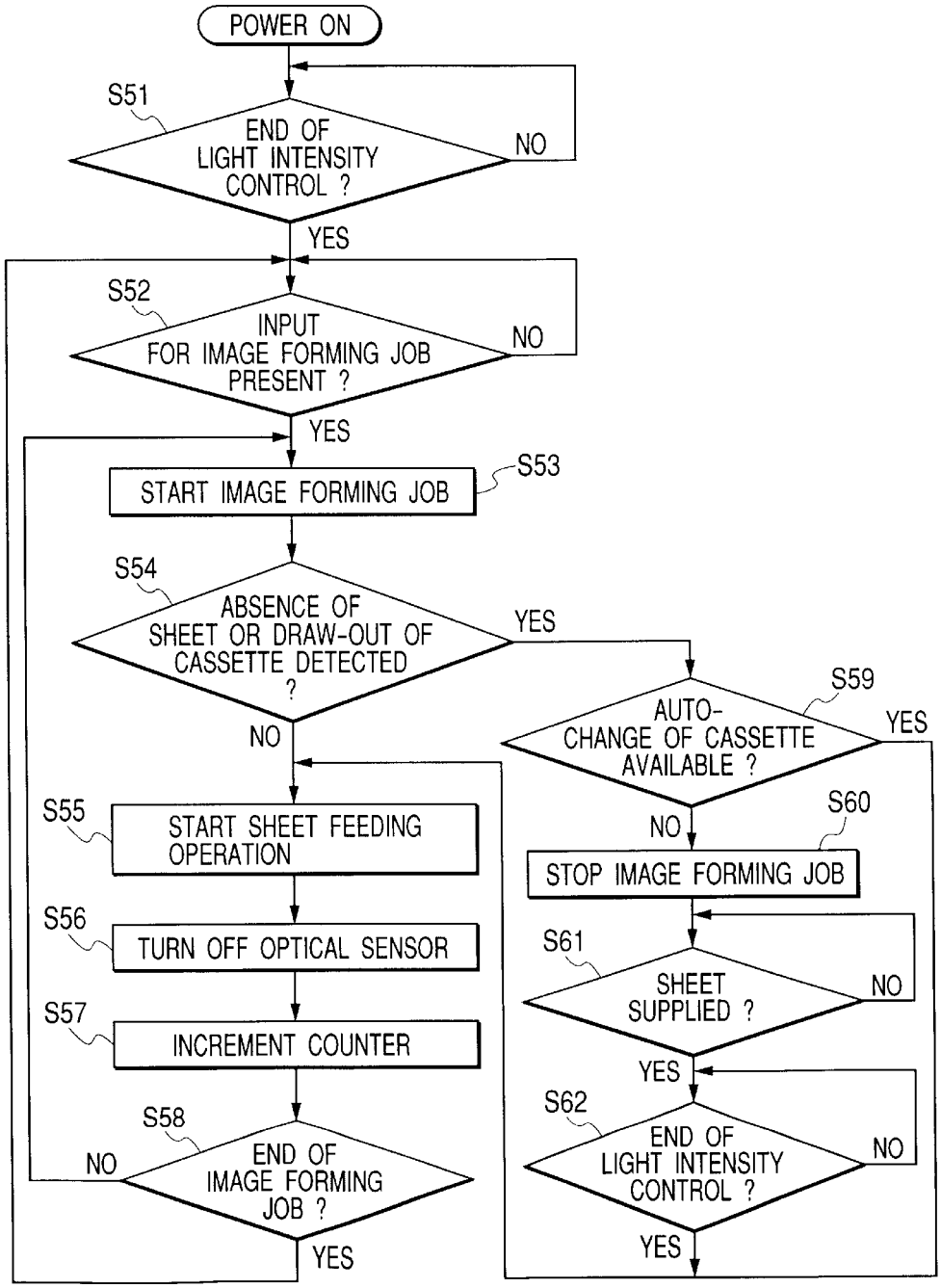
FIG. 12 is a flow chart concerning an image formation sequence in a third embodiment of the present invention.

FIG. 12 is a flow chart concerning an image forming operation sequence by the CPU 401 in the third embodiment. A control program in accordance with this flow chart is written in the internal memory of the CPU 401.

When a user turns on a power source, since flash control of all optical sensors is performed simultaneously with an initial operation required for starting up a printer, the CPU 401 judges if the flash control has ended (S51). Then, after the completion of the flash control, the CPU 401 judges if an instruction of an image forming job has been inputted from an control unit or the like (S52). If the instruction has been inputted, the CPU 41 starts the image forming job (S53), and at the same time, detects presence or absence of sheets in a designated sheet cassette to judge if the sheet cassette has been drawn out (S54). Then, if sheets are present in the designated sheet cassette and the sheet cassette has not been drawn out, the CPU 401 starts a sheet feeding operation such as rotating the sheet feeding motor 504 (S55).

As described with reference to FIG. 2, at this point, the reflective optical sheet sensor 202 detects a conveyed sheet to be turned off, and thereafter, the reflective optical sheet sensor 203 is also turned off (S56). Then, the CPU 401 increments the counter 601 when the trailing end of the sheet has passed through the reflective optical sheet sensor 202 and the reflective optical sheet sensor 202 is turned on while performing the image forming operation, and subsequently increments the counter 602 when the reflective optical sheet sensor 203 is turned on (S57). The count values are stored in the RAM 502 and updated. Then, the CPU 401 judges if the image forming job has ended, and if the image forming job has ended, returns to S32, and if not, returns to S53 (S58).

Here, if it is judged that sheets are absent or the sheet cassette is drawn out in S54, the CPU 401 judges if automatic cassette change is available (S59), and if it is possible, returns to S55 to start a sheet feeding operation with another cassette. If the automatic cassette change is impossible, the CPU 401 stops the image forming job (S60), and checks if sheets have been supplied (S61). If the sheets have been supplied and flash control performed at the time when the sheet feeding cassette is drawn out in supplying sheets has ended (S62), the CPU 401 returns to S55 to resume the sheet feeding operation.

Here, since the flash control has been started in the state in which the sheet cassette is drawn out, it is finished by the time when the sheets are supplied and the sheet cassette is returned to a normal position to start printing in most cases. Therefore, there is no downtime due to the flash control operation.

The timing for staring the flash control is not limited to the above-described embodiment but may be, for example, a point when the sheet cassette is drawn out and only the transition from the state of absence of sheets to the state of presence of sheets in the sheet cassette is detected. In this case, since it is meaningless to control flash when there is no sheet in the sheet cassette, it is desirable to perform real time flash control at timing when sheet supply is possible.

In addition, regardless of presence or absence of supply of sheets to the sheet cassette, the timing may be a point when the cassette sensors 231, 233 and the like detect only the transition from the state in which the sheet cassette is drawn out to the state in which the sheet cassette is normally mounted. In this case, since flash is controlled even in the state in which sheets are supplied while sheets still remain in the sheet cassette, the flash can be controlled at appropriate timing even if sheets are continuously supplied and used before the sheet cassette comes to be in the state of absence of sheets.

Figure 13:
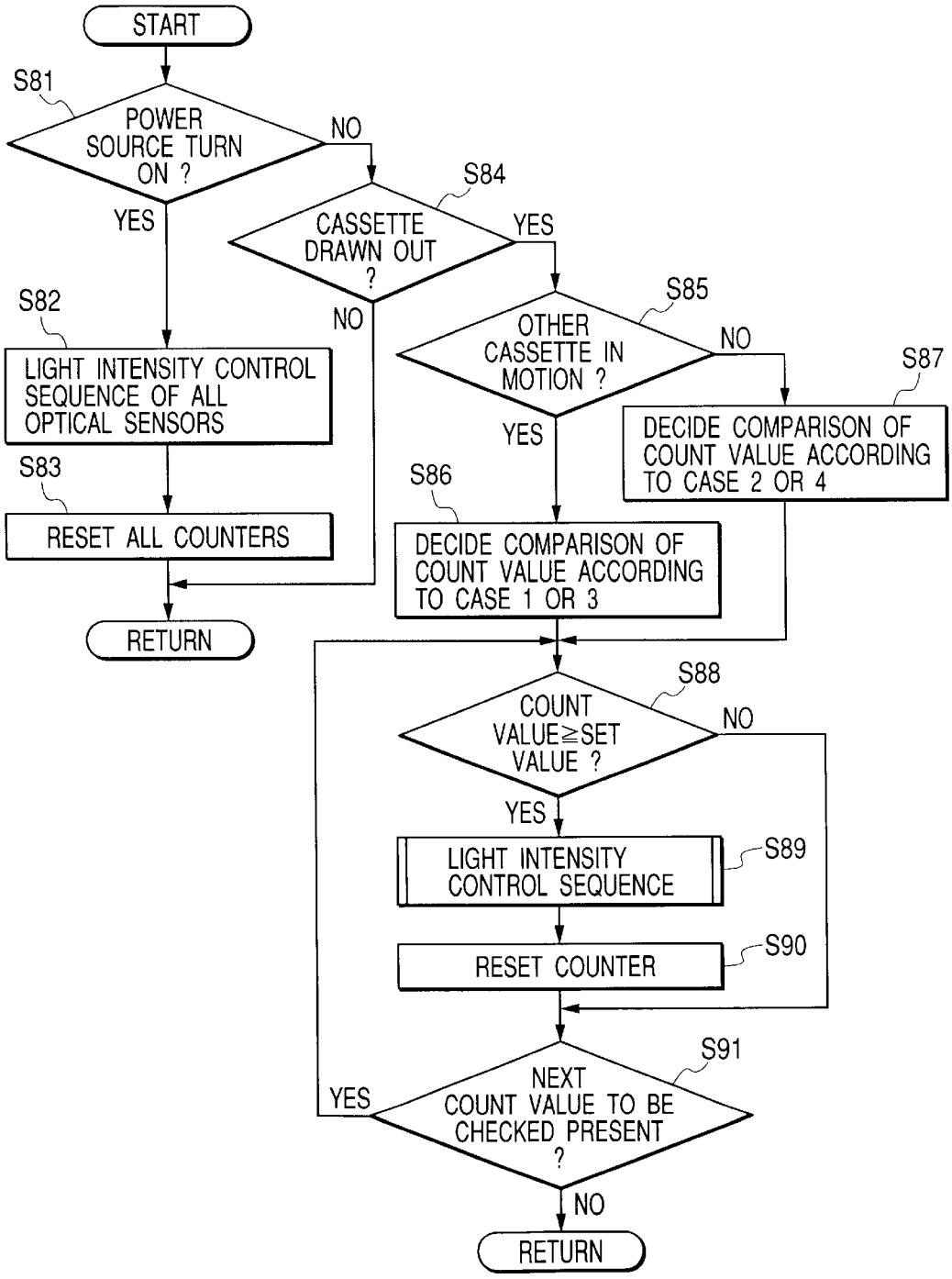
FIG. 13 is a flow chart concerning a flash control sequence of a reflective optical sheet sensor in the third embodiment of the present invention.

FIG. 13 is a flow chart concerning a flash control operation deciding sequence of a reflective optical sheet sensor by the CPU 401 in the third embodiment. A control program in accordance with this flow chart is written in the internal memory of the CPU 401. This program is started in parallel with the program of FIG. 12.

In this flow chart, the program is started as a power source is turned on. When the power source is turned on (S81), the CPU 401 performs flash control of all reflective optical sheet sensors in accordance with the flash control sequence of FIG. 8 (S82). Upon completing the flash control of all the reflective optical sheet sensors, the CPU 401 resets a counter value according to outputs of all the reflective optical sheet sensors to zero (S83).

If the power source is not on in S81, the CPU 401 judges if the sheet cassette is drawn out (S84). If the sheet cassette is not drawn out, the CPU 401 judges if another cassette is in motion (S85). If another cassette is in motion, the CPU 401 decides comparison of a count value corresponding to a reflective optical sheet sensor according to a case 1 or a case 3 discussed below with reference to FIG. 14 (S86). In addition, if another cassette is in the stop state, the CPU 401 decides comparison of a count value corresponding to a reflective optical sheet sensor according to a case 2 or a case 4 discussed below with reference to FIG. 14 (S87).

The CPU 401 compares the count value decided in S86 corresponding to the reflective optical sheet sensor, which is stored in the RAM 502, and a fixed set value calculated from values of durable time and an amount of paper powder measured in advance, which are stored in the ROM 501 (S88). If the count value stored in the RAM 502 is equal to or larger than the count value stored in the ROM 501, the CPU 401 applies the flash control sequence of FIG. 8 to a reflective optical sheet sensor corresponding to the count value (S89). Then, the CPU 401 resets a count value corresponding to the reflective optical sheet sensor for which the flash control ends (S90), and if a count value to be compared next is present (S91), returns to S88 to perform comparison of count values.

Here, in the above-described embodiment, the number of times of turning on the reflective optical sheet sensor is counted up. However, the present invention is not limited to this. The number of times of turning off the reflective optical sheet sensor may be counted, or a set value of the ROM may be registered as a count value of the RAM at an initial time and counted down. Moreover, when the set value is counted down to be zero, a flash control flag may be set. Then, when the sheet cassette is drawn out, a flag check sequence may be operated to start a flash control sequence.

In addition, the reset of the counter is executed after turning on the power source in this embodiment. However, the reset of the counter may be executed before turning off the power source.

FIG. 14 is a table showing an example of sensors that should be subjected to flash control at the time of supply of sheets. A method of deciding a sensor to be subjected to comparison of count values will be described by showing specific examples of S56 at timing when the sheet cassette is drawn out with reference to the table of FIG. 14.

(Case 1)

When the sheet cassette 250 of the sheet feeding section 37 is drawn out in the state in which the sheet cassette 240 of the sheet feeding section 36 of FIG. 2 is executing a job and is performing continues sheet feeding, the sensors 202 and 203 are used for the continuous sheet feeding and cannot be subjected to flash control, so that comparison of count values of the sensors 212 and 213 is performed.

(Case 2)

When sheet feeding of the sheet feeding section 36 of FIG. 2 is suspended, and the sheet cassette 250 of the sheet feeding section 37 is drawn out, there is a large loss of time if count values of all the sensors are compared and all the sensors are subjected to flash control, so that comparison of count values of the sensors 203, 212 and 213, which are used by the mounted sheet cassette for sheet feeding, is performed.

(Case 3)

When sheets are supplied to the sheet cassette 240 of the sheet feeding section 36 and the sheet cassette is normally mounted in the state in which the sheet cassette 250 of the sheet feeding section 37 of FIG. 2 is executing a job and is performing continuous sheet feeding, the sensors 203, 212 and 213 are used for the continuous sheet feeding and cannot be subjected to the flash control, so that comparison of a count value of the sensor 202 is performed.

(Case 4)

When: sheet feeding of the sheet feeding section 37 of FIG. 2 is suspended; sheets are supplied to the sheet cassette 240 of the sheet feeding section 36; and the sheet cassette is normally mounted, there is a large loss of time if count values of all the sensors are compared and all the sensors are subjected to flash control, so that comparison of count values of the sensors 203 and 203, which are used by the mounted sheet cassette for sheet feeding, is performed.

In the above-described cases, sensors that are used in the case in which sheets are fed to a sheet cassette at the time of the sheet supply operation, operations among the sensors are subjected to the flash control sequence according to the count value of the number of sheets that have passed the sensor. Moreover, even in the case in which sheets are continuously fed from a separate sheet feeding section, among sensors that are used in the case in which the sheets are fed, sensors are subjected to the flash control operations as long as the sensors require the flash control operations and can be subjected to the flash control operations. Consequently, it becomes possible to delete needless flash control of the optical sensors, which will lead to reduction of downtime, and to perform stable sheet conveyance in which sheet jam is not detected by mistake.

Moreover, even while an automatic cassette change function is operating or during continuous sheet feeding from another sheet cassette, an image forming job can be prevented from being stopped in the middle for flash control operation, resulting in reduction of downtime.

In addition, the above-described cases of FIG. 14 are not limited to these, and for example, an optical sensor that requires a flash control operation changes depending on a structure of a sheet feeding section, an arrangement of optical sensors, or the like.

In this case, the flash control operation is applied to all reflective optical detection sensors arranged in the image forming apparatus, whereby the number of times an image forming job is stopped in the middle can be reduced, and stable sheet conveyance can be performed even while a large amount of image formation is being performed. Further, although only the image forming apparatus with the optical sensors arranged in the sheet feeding sections is shown in this embodiment, the image forming apparatus of the present invention is not limited to this. For example, the present invention may be applied to an image forming apparatus with optical sensors arranged in a sheet discharging section, a finisher, or a both-side path.

The present invention is not limited to the above embodiments, and various changes and modifications can be made within the spirit and scope of the present invention. Therefore to appraise the public of the scope of the present invention, the following claims are made.

What is claimed is:

1. An image forming apparatus comprising:

a sheet containing section for containing sheets;

a conveying member and a conveying path for conveying the sheets;

at least one optical sensor that is arranged in said conveying path and has a light emitting element and a light receiving element for detecting presence or absence of a sheet on said conveying path;

a driver for changing an amount of emitted light of said optical sensor;

a sheet supply operation detecting section for detecting a supply operation of the sheets contained in said sheet containing section; and a control section for adjusting an amount of emitted light of said optical sensor according to an output of said sheet supply operation detecting section.

2. An image forming apparatus according to claim 1, wherein said optical sensor is provided with said light emitting element and said light receiving element arranged adjacent with each other and a reflecting mechanism arranged opposite said light emitting element and said light receiving element.

3. An image forming apparatus according to claim 1, wherein said control section has a plurality of sheet containing sections and adjusts the amount of emitted light of said optical sensor in accordance with a sheet containing section for which sheet supply is detected by said sheet supply operation detecting section.

4. An image forming apparatus according to claim 3, wherein said control section adjusts the amount of emitted light of said optical sensor in accordance with a sheet containing section which is not used during sheet feeding from another sheet containing section and for which sheet supply is detected by said sheet supply operation detecting section.

5. An image forming apparatus according to claim 1, wherein said sheet supply operation detecting section detects transition from a state of absence of sheets to a state of presence of sheets of said sheet containing section.

6. An image forming apparatus according to claim 1, wherein said sheet supply operation detecting section detects a state in which said sheet containing section is drawn out.

7. An image forming apparatus according to claim 1, wherein said sheet supply operation detecting section detects transition from a state in which said sheet containing section is drawn out to a state in which said sheet containing section is mounted.

8. An image forming apparatus comprising:

a sheet containing section for containing sheets;

a conveying member and a conveying path for conveying the sheets;

at least one optical sensor that is arranged in said conveying path and has a light emitting element and a light receiving element for detecting a presence or absence of a sheet on said conveying path;

a driver for changing an amount of emitted light of said optical sensor;

a counter for counting sheets every time a sheet passes through said optical sensor; and a control section for adjusting an amount of emitted light of said optical sensor according to a judgment on whether a value of said counter reaches a predetermined value.

9. An image forming apparatus according to claim 8, wherein said optical sensor is provided with said light emitting element and said light receiving element arranged adjacent with each other and a reflecting mechanism arranged opposite said light emitting element and said light receiving element.

10. An image forming apparatus according to claim 8, further comprising a sheet supply operation detecting section for detecting a supply operation of the sheets contained in said sheet containing section, wherein said control section judges whether the value of said counter reaches the predetermined value according to an output of said sheet supply operation detecting section.

11. An image forming apparatus according to claim 10, wherein said sheet supply operation detecting section detects a state in which said sheet containing section is drawn out.

12. An image forming apparatus according to claim 10, wherein said sheet supply operation detecting section detects transition from a state of an absence of sheets to a state of a presence of sheets of said sheet containing section.

13. An image forming apparatus according to claim 10, wherein said sheet supply operation detecting section detects transition from a state in which said sheet containing section is drawn out to a state in which said sheet containing section is mounted.

14. An image forming apparatus according to claim 8, wherein said apparatus includes a plurality of sheet containing sections and said control section judges whether the value of said counter reaches the predetermined value in accordance with a sheet containing section for which sheet supply is detected by a sheet supply operation detecting section.

15. An image forming apparatus according to claim 8, wherein said apparatus includes a plurality of sheet containing sections and said control section judges whether the value of said counter reaches the predetermined value in accordance with a sheet containing section which is not used during sheet feeding from another sheet containing section and for which sheet supply is detected by a sheet supply operation detecting section.

16. An image forming apparatus according to claim 8, wherein, if the amount of emitted light of said optical sensor is adjusted, said control section resets a value of a counter corresponding to said optical sensor for which the amount of emitted light is adjusted.

17. An image forming apparatus comprising:

a sheet containing section for containing sheets;

a conveying member and a conveying path for conveying the sheets;

at least one optical sensor that is arranged in said conveying path and has a light emitting element and a light receiving element for detecting a presence or absence of a sheet on said conveying path;

a driver for changing an amount of emitted light of said optical sensor;

a control section for judging whether or not an amount of emitted light of said optical sensor is adjusted, and for, even with the judgement that the amount of emitted light of said optical sensor is to be adjusted, stopping the adjustment of the amount of emitted light of said optical sensor in the case where said optical sensor detects a presence of a sheet on said sheet conveying path.

18. An image forming apparatus according to claim 17, wherein said optical sensor is provided with said light emitting element and said light receiving element arranged adjacent with each other and a reflecting mechanism arranged opposite said light emitting element and said light receiving element.

19. An image forming apparatus according to claim 17, wherein said optical sensor includes an optical sensor closest to said sheet containing section.

20. An image forming apparatus according to claim 19, wherein, even if a sheet is detected by said optical sensor closest to said sheet containing section, said control section does not regard it as holdup jam.

21. An image forming apparatus according to claim 17, further comprising sheet supply operation detecting means, wherein said control section adjusts the amount of emitted light of said optical sensor in accordance with an output of said sheet supply operation detecting means.

22. An image forming apparatus according to claim 17, further comprising a counter for counting sheets every time a sheet passes through said optical sensor, wherein said control section adjusts the amount of emitted light of said optical sensor in accordance with judgment on whether a value of said counter reaches a predetermined value.

23. A method of controlling an amount of light of an optical sensor in an image forming apparatus, comprising:

a step of conveying sheets from a sheet containing section containing the sheets;

a step of detecting a presence or absence of a sheet on a conveying path using at least one optical sensor that is arranged in said conveying path and has a light emitting element and a light receiving element;

a step of detecting a supply operation of the sheets contained in said sheet containing section; and a step of adjusting an amount of emitted light of said optical sensor in accordance with a result of detection of said step of detecting a supply operation.

24. A method of controlling an amount of light of an optical sensor in an image forming apparatus, comprising:

a step of conveying sheets from a sheet containing section containing the sheets;

a step of detecting a presence or absence of a sheet on a conveying path using at least one optical sensor that is arranged in said conveying path and has a light emitting element and a light receiving element;

a step of counting the sheets every time a sheet passes through said optical sensor;

a step of judging whether a value of said counter reaches a predetermined value; and a step of adjusting an amount of emitted light of said optical sensor in accordance with a result of said step of judgment on the value of said counter.

25. A method of controlling an amount of light of an optical sensor in an image forming apparatus, comprising:

a step of conveying sheets from a sheet containing section for containing the sheets;

a step of detecting a presence or absence of a sheet on a conveying path using at least one optical sensor that is arranged in said conveying path and has a light emitting element and a light receiving element;

a step of judging whether or not an amount of emitted light of said optical sensor is adjusted; and a step of stopping the adjustment of the amount of emitted light of said optical sensor in the case where said optical sensor detects a presence of a sheet on said sheet conveying path, even with the judgement that the amount of emitted light of said optical sensor is to be adjusted.

26. An image forming apparatus comprising:

a sheet containing section for containing sheets;

a conveyer for conveying the sheets fed from said sheet containing section in a conveying path;

at least one optical sensor that is arranged in the conveying path and has a light emitting element and a light receiving element for detecting a presence or absence of a sheet on the conveying path;

a detecting section for detecting a state of said sheet containing section being drawn out; and a control section for adjusting an amount of emitted light of said optical sensor according to an output of said detecting section.

27. An image forming apparatus comprising:

a sheet containing section for containing sheets;

a conveyer for conveying the sheets fed from said sheet containing section in a conveying path;

at least one optical sensor that is arranged in the conveying path and has a light emitting element and a light receiving element for detecting a presence or absence of a sheet on the conveying path;

a detecting section for detecting a state of said sheet containing section being drawn out; and a control section for adjusting an amount of emitted light of said optical sensor said detecting section.

28. An image forming apparatus comprising:

a sheet containing section for containing sheets;

a conveyer for conveying the sheets fed from said sheet containing section in a conveying path;

at least one optical sensor that is arranged in the conveying path and has a light emitting element and a light receiving element for detecting a presence or absence of a sheet on the conveying path;

a counter for counting sheets every time a sheet passes through said optical sensor; and a control section for adjusting an amount of emitted light of said optical sensor according to a judgement as to whether a value of said counter reaches a predetermined value.

29. An image forming apparatus comprising:

a sheet containing section for containing sheets;

a conveyer for conveying the sheets fed from said sheet containing section in a conveying path;

at least one optical sensor that is arranged in the conveying path and has a light emitting element and a light receiving element for detecting a presence or absence of a sheet on the conveying path; and a control section for inhibiting the adjustment of an amount of emitted light of said optical sensor in a case where said optical sensor detects the presence of a sheet on the sheet conveying path.

* * * * *

UNITED STATES PATENT AND TRADEMARK OFFICE

CERTIFICATE OF CORRECTION

PATENT NO. : 6,804,474 B2
DATED : October 12, 2004
INVENTOR(S) : Tetsuya Morita et al.

It is certified that error appears in the above-identified patent and that said Letters Patent is hereby corrected as shown below:

Column 1,
Lines 10 and 37, "presence" should read -- the presence --.
Line 49, "such a" should read -- the aforementioned --; "disadvantage" should read -- disadvantages --; and "detect" should read -- detect the --.
Line 58, "has a" should read -- is --; and "disadvantage" should read -- disadvantages --.
Line 59, "that an" should read -- in that the --.
Line 62, "deteriorates" should read -- which deteriorates --.
Line 63, "by" should read -- due to --.
Line 66, "is flown," should read -- flows, --.

Column 2,
Line 52, "too many," should read -- too high, --.
Line 56, "accuracy of" should read -- sheet detection accuracy --.
Line 57, "detecting sheets" should be deleted; "become a" should be deleted; "cause of" should read -- cause an erroneous --; and "wrong" should be deleted.

Column 4,
Lines 4 and 19, "feed" should read -- feeding --.
Line 44, "which are" should read -- each --.

Column 5,
Lines 39 and 51, "presence" should read -- the presence --.
Line 42, "at timing of" should be deleted.
Line 57, "feed" should read -- feeding --.
Line 63, "jam" should read -- a jam --.

Column 6,
Lines 18, 25, 41, 48 and 53, "holdup" should read -- a holdup --.
Line 30, "holdup" (both occurrences) should read -- a holdup --.
Line 43, "feeding, it" should read -- feeding. It --.
Line 44, "jam" should read -- a holdup jam --.
Line 49, "when" should read -- as when --.
Line 58, "presence" should read -- the presence --.

Column 7,
Line 4, "feeing" should read -- feeding --.
Line 26, "arranged" should read -- are arranged --; and "adjacent" should read -- adjacent to --.
Line 30, "opposed" should read -- opposed to --.
Line 49, "is flown," should read -- flows, --.
Line 50, "303," should read -- 303, either --.

UNITED STATES PATENT AND TRADEMARK OFFICE

CERTIFICATE OF CORRECTION

PATENT NO. : 6,804,474 B2
DATED : October 12, 2004
INVENTOR(S) : Tetsuya Morita et al.

It is certified that error appears in the above-identified patent and that said Letters Patent is hereby corrected as shown below:

Column 7 (cont'd),
Line 52, "amount" should read -- amount of --.
Line 62, "feed" should read -- feeding --.

Column 8,
Line 54, "to the" should read -- to component failure resulting from exceeding the --.
Line 55, "power" should read -- powder --.
Line 56, "if a" should read -- if the --.
Line 60, "level" should read -- predetermined level,--
Line 61, "decided in advance," should be deleted.

Column 9,
Line 30, "concerning" should read -- illustrating --.
Line 34, "written" should read -- stored --.
Line 66, "regards" should read -- determines --.

Column 10,
Lines 13 and 24, "presence" should read -- the presence --; and "supply" should read -- a supply --.
Line 19, "remains" should read -- remain --.
Line 25, "imme-" should read -- started imme- --.
Line 26, "started" should be deleted.
Line 30, "when" should be deleted.

Column 11,
Lines 16 and 34, "continues" should read -- continuous --.
Lines 21 and 39, "When:" should read -- When --.
Lines 22 and 40, "suspended;" should read -- suspended, --.
Line 23, "section 37;" should read -- section 37 --.
Line 24, "time since" should read -- time. This is because --.
Line 25, "if all" should read -- so all --.
Line 41, "section 36;" should read -- section 36 --.
Line 44, "203 and 203," should read -- 202 and 203, --.
Line 64, "these," should read -- these specifically described --; and "example," should read -- example, may include --.

Column 12,
Line 60, "presence" should read -- the presence --.
Line 62, "opening" should read -- the opening --.

UNITED STATES PATENT AND TRADEMARK OFFICE

CERTIFICATE OF CORRECTION

PATENT NO. : 6,804,474 B2
DATED : October 12, 2004
INVENTOR(S) : Tetsuya Morita et al.

It is certified that error appears in the above-identified patent and that said Letters Patent is hereby corrected as shown below:

Column 13,
Line 6, "an control" should read -- a control --.
Line 7, "presence" should read -- the presence --.

Column 14,
Line 25, "an control" should read -- a control --.
Line 65, "staring" should read -- starting of --.

Column 15,
Line 63, "be" should be deleted.

Column 16,
Line 35, "When:" should read -- When --.
Line 36, "suspended;" should read -- suspended, --.
Line 37, "36;" should read -- 36, --.

Column 17,
Lines 26 and 59, "presence" should read -- a presence --.
Line 58, "absence" should read -- an absence --.

Column 20,
Line 37, "sensor said" should read -- sensor in accordance with detection of a transition from the state of said sheet containing section being drawn out to a state of said sheet containing section being mounted by said.--

Signed and Sealed this

First Day of February, 2005

JON W. DUDAS
*Director of the United States Patent and Trademark Office*